United States Patent [19]

Komori et al.

[11] Patent Number: 4,770,229

[45] Date of Patent: Sep. 13, 1988

[54] HORIZONTAL TYPE CONTINUOUS CASTING MACHINE FOR CASTING MOLTEN STEEL INTO CAST STEEL STRAND

[75] Inventors: Shigeki Komori, Kawasaki; Masahiro Tsuru, Yokohoma, both of Japan

[73] Assignee: Nippon Kokan Kabushiki Kaisha, Tokyo, Japan

[21] Appl. No.: 63,704

[22] Filed: Jun. 15, 1987

Related U.S. Application Data

[63] Continuation of Ser. No. 808,347, Dec. 12, 1985, abandoned.

[30] Foreign Application Priority Data

Dec. 28, 1984 [JP] Japan ..... 59-274676
Dec. 28, 1984 [JP] Japan ..... 59-274677

[51] Int. Cl.[4] ..... B22D 11/00
[52] U.S. Cl. ..... 164/440; 164/490
[58] Field of Search ..... 164/490, 440, 441, 417

[56] References Cited

U.S. PATENT DOCUMENTS 3,642,058 2/1972 Webbere ..... 164/440

FOREIGN PATENT DOCUMENTS 1558168 3/1970 Fed. Rep. of Germany .
2113870 10/1971 Fed. Rep. of Germany .
2100423 11/1972 Fed. Rep. of Germany .
De. 2935170 8/1981 Fed. Rep. of Germany .
5122629 2/1976 Japan ..... 164/440
570216 12/1975 Switzerland ..... 164/440
2009000 6/1979 United Kingdom ..... 164/440

OTHER PUBLICATIONS

European Pat. Appln., No. EP 85309,343.3.

*Primary Examiner*—Nicholas P. Godici
*Assistant Examiner*—Richard K. Seidel
*Attorney, Agent, or Firm*—Frishauf, Holtz, Goodman & Woodward

[57] ABSTRACT

A horizontal type continuous casting machine for casting molten steel into a cast steel strand, which comprises: a tundish for receiving molten steel to be cast; a horizontal metal mold connected through a front nozzle, a feed nozzle, a break ring and a metal spacer ring having therein a cooling water passage to an opening provided in the lower portion of a side wall of the tundish; at least one pair of pinch rolls for intermittently and continuously withdrawing molten steel directed from the tundish to the horizontal mold into a cast steel strand in the horizontal direction through the horizontal mold by means of a plurality of cycles each comprising one pull and one push; and a cooling zone for cooling the cast steel strand withdrawn from the horizontal mold.

5 Claims, 5 Drawing Sheets

HORIZONTAL TYPE CONTINUOUS CASTING MACHINE FOR CASTING MOLTEN STEEL INTO CAST STEEL STRAND

This application is a continuation, of application Ser. No. 808,347, filed Dec. 12, 1985 now abandoned.

FIELD OF THE INVENTION

The present invention relates to a horizontal type continuous casting machine for casting molten steel into a cast steel strand, which permits an easy and liquid-tight connection of the downstream end of a break ring to the inlet end of a horizontal mold in a short period of time.

BACKGROUND OF THE INVENTION

A horizontal type continuous casting machine for casting molten steel into a cast steel strand has recently been industrialized. In this casting machine, molten steel directed from a tundish to a horizontal mold is intermittently and continuously withdrawn into a cast steel strand in the horizontal direction through the horizontal mold by means of a plurality of cycles each comprising a pull and a push.

The above-mentioned conventional horizontal type continuous casting machine is described below with reference to FIG. 1. In FIG. 1, 1 is a tundish for receiving molten steel. A horizontal metal mold 6 is connected through a front nozzle 3, a feed nozzle 4 and a break ring 5 to an opening 1A provided in the lower portion of a side wall of the tundish 1. The upstream end of the front nozzle 3 is inserted into the opening 1A of the tundish 1, and the downstream end of the front nozzle 3 is connected to the upstream end of the feed nozzle 4. The downstream end of the feed nozzle 4 is connected to the upstream end of the break ring 5, and the downstream end of the break ring 5 is connected to the inlet end 6A of the horizontal mold 6. Thus, the opening 1A of the tundish 1, the front nozzle 3, the feed nozzle 4, the break ring 5 and the horizontal mold 6 form a horizontal passage for molten steel.

The break ring 5 has the function of forming a sure starting point of solidification of molten steel 2 introduced from the tundish 1 through the front nozzle 3, the feed nozzle 4 and the break ring 5 into the horizontal mold 6, and thus ensuring smooth withdrawal of a cast steel strand 7 from the horizontal mold 6. The inlet end 6A of the horizontal mold 6 is formed so as to match with the tapered outer surface 5A of the break ring 5, and the outer surface 5A of the break ring 5 comes into a liquid-tight contact with the inlet end 6A of the horizontal mold 6 by urging the break ring 5 toward the horizontal mold 6 by means of the feed nozzle 4. The horizontal mold 6 is made of copper or a copper alloy added with beryllium, and has therein a cooling water passage 6B. Cooling water circulates through the cooling water passage 6B to cool the horizontal mold 6.

At least one pair of pinch rolls (not shown) and a cooling zone (not shown) are arranged following the horizontal mold 6. The at least one pair of pinch rolls intermittently and continuously withdraws molten steel 2 directed to the horizontal mold 6 into a cast steel strand 7 in the horizontal direction through the horizontal mold 6 by means of a plurality of cycles each comprising a pull and a push. The cooling zone cools the cast steel strand 7 thus withdrawn from the horizontal mold 6.

According to the above-mentioned conventional horizontal type continuous casting machine, the cast steel strand 7 is manufactured as follows. Molten steel 2 received in the tundish 1 is introduced through the front nozzle 3, the feed nozzle 4 and the break ring 5 into the horizontal mold 6. Molten steel 2 introduced into the horizontal mold 6 is intermittently and continuously withdrawn into the cast steel strand 7 in the horizontal direction through the horizontal mold 6 by the at least one pair of pinch rolls (not shown). Then, the cast steel strand 7 thus withdrawn from the horizontal mold 6 is cooled while passing through the cooling zone (not shown). The cast steel strand 7 is thus continuously cast.

In the above-mentioned conventional horizontal type continuous casting machine, the break ring 5 has the function of forming a sure starting point of solidification of molten steel introduced into the horizontal mold 6. It is therefore important to liquid-tightly connect the outer surface 5A of the break ring 5 with the inlet end 6A of the horizontal mold 6 so as not to produce a gap therebetween. If a gap is produced between the outer surface 5A of the break ring 5 and the inlet end 6A of the horizontal mold 6, deposited metal formed by solidification of molten steel 2 penetrating into this gap during casting is caught by the gap, and this causes breakage of a solidified shall 7A of the cast steel strand 7 during pull thereof, thus imparing smooth formation of the solidified shell 7A. Defects are produced as a result on the surface of the cast steel strand 7 and may cause breakout of molten steel 2 and breakage of the break ring 5.

It is therefore the conventional practice, when replacing the break ring 5, to conduct a fitting operation by repeatedly trying to fit the outer surface 5A of the refractory break ring 5 to the inlet end 6A of the horizontal mold 6 upon every grinding of the outer surface 5A of the break ring 5 so that a gap is not produced between the outer surface 5A of the break ring 5 and the inlet end 6A of the horizontal mold 6, in order to ensure a liquid-tight connection of the downstream end of the break ring 5 to the inlet end 6A of the horizontal mold 6. However, it is not easy to verify, in the assembled state of the horizontal mold 6 into the line, that no gap is produced between the outer surface 5A of the break ring 5 and the inlet end 6A of the horizontal mold 6. Consequently, the fitting operation of the break ring 5 requires much labor and time, and it is not easy to liquid-tightly connect the downstream end of the break ring 5 to the inlet end 6A of the horizontal mold 6.

Under such circumstances, there is a strong demand for the development of a horizontal type continuous casting machine for casting molten steel into a cast steel strand, which permits an easy and liquid-tight connection of the downstream end of the break ring 5 to the inlet end 6A of the horizontal mold 6 in a short period of time by facilitating the above-mentioned fitting operation of the break ring 5, but a horizontal type continuous casting machine provided with such properties has not as yet been proposed.

SUMMARY OF THE INVENTION

An object of the present invention is therefore to provide a horizontal type continuous casting machine for casting molten steel into a cast steel strand, which permits an easy and liquid-tight connection of the downstream end of the break ring to the inlet end of the horizontal mold in a short period of time.

A principal object of the present invention is to provide a horizontal type continuous casting machine for casting molten steel into a cast steel strand, which permits an easy and liquid-tight connection of the downstream end of the break ring to the inlet end of the horizontal mold in a short period of time by facilitating the fitting operation of the break ring.

In accordance with one of the features of the present invention, there is provided a horizontal type continuous casting machine for casting molten steel into a cast steel strand, which comprises:

a tundish for receiving molten steel to be cast; a horizontal metal mold connected through a front nozzle, a feed nozzle and a break ring to an opening provided in the lower portion of a side wall of said tundish, the upstream end of said front nozzle being inserted into said opening of said tundish, the downstream end of said front nozzle being connected to the upstream end of said feed nozzle, the downstream end of said feed nozzle being connected to the upstream end of said break ring, the downstream end of said break ring being connected to the inlet end of said horizontal mold, thereby said opening of said tundish, said front nozzle, said feed nozzle, said break ring and said horizontal mold forming a horizontal passage for molten steel; at least one pair of pinch rolls for intermittently and continuously withdrawing molten steel directed from said tundish through said front nozzle, said feed nozzle and said break ring to said horizontal mold into a cast steel strand in the horizontal direction through said horizontal mold by means of a plurality of cycles each comprising one pull and one push; and a cooling zone for cooling said cast steel strand withdrawn from said horizontal mold;

characterized in that:

a metal spacer ring (8, 12) having therein a cooling water passage (8A, 12A) is provided between said break ring (5) and said horizontal mold (6), the downstream side (8D, 12D) of the outer surface of said spacer ring (8, 12) is in contact with said inlet end (6A) of said horizontal mold (6), the upstream side (8C, 12C) of the inner surface of said spacer ring (8, 12) is in contact with the outer surface (5A) of said break ring (5), and an inner bore (9, 13) of said spacer ring (8, 12), formed by the downstream side (8B, 12B) of the inner surface of said spacer ring (8, 12), forms part of said horizontal passage for molten steel in cooperation with the inner bore (10, 15) of said horizontal mold (6), formed by the inner surface (6C) of said horizontal mold (6).

DETAILED DESCRIPTION OF PREFERRED EMBODIMENTS

From the above-mentioned point of view, we carried out extensive studies to develop a horizontal type continuous casting machine for casting molten steel into a cast steel strand, which permits an easy and liquid-tight connection of the downstream end of the break ring to the inlet end of the horizontal mold in a short period of time by facilitating the fitting operation of the break ring.

As a result, we obtained the following finding: by providing a metal spacer ring between the refractory break ring and the horizontal metal mold, it suffices to conduct the fitting operation only between the break ring and the spacer ring when connecting the downstream end of the break ring to the inlet end of the horizontal mold, and by once fabricating the spacer ring and the horizontal mold, which are both made of metal, so as not to produce a gap therebetween, it is not necessary to fabricate these parts again upon every connection of the break ring. Furthermore, by taking off the spacer ring from the horizontal mold, the fitting operation of the break ring to the spacer ring can be performed offline, and thus the absence of a gap between the outer surface of the break ring and the inlet end of the spacer ring can be easily verified. It is therefore possible to easily connect liquid-tightly the downstream end of the break ring to the inlet end of the horizontal mold in a short period of time.

The present invention was made on the basis of the above-mentioned finding. The horizontal type continuous casting machine of the present invention for casting molten steel into a cast steel strand is described below with reference to the drawings.

Figure 6:
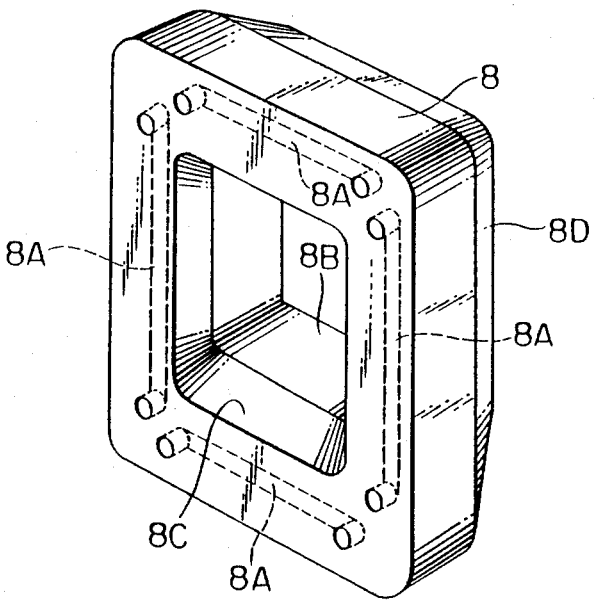
FIG. 6 is a perspective view illustrating an example of a metal spacer ring which is provided between a break ring and a horizontal mold of the horizontal type continuous casting machine of the present invention as shown in FIG. 5.
Figure 5:
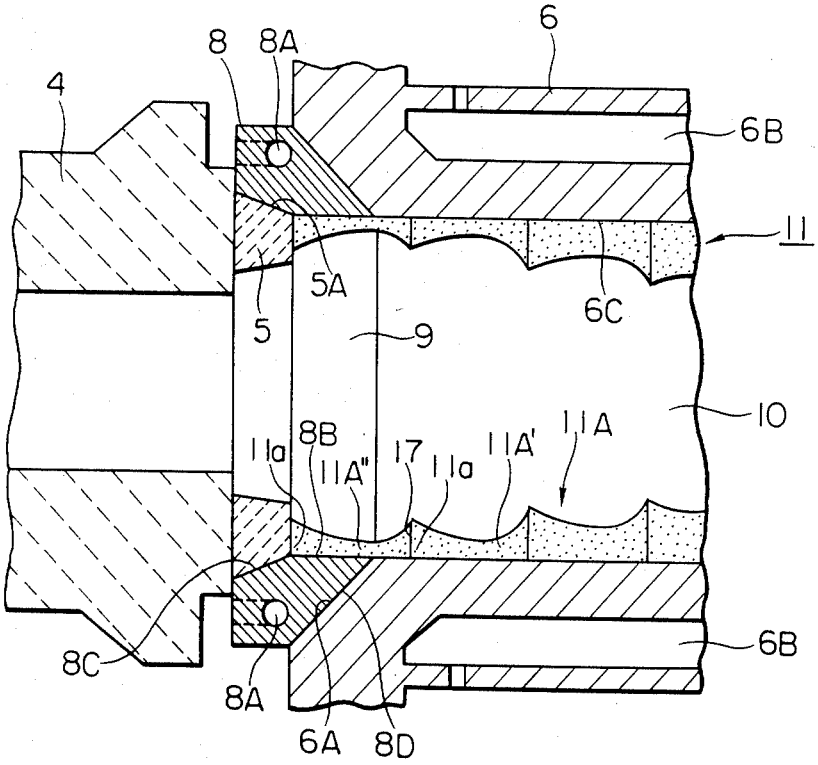
FIG. 5 is a schematic vertical sectional view illustrating a first embodiment of the horizontal type continuous casting machine of the present invention for casting molten steel into a cast steel strand.

FIG. 5 is a schematic vertical sectional view illustrating a first embodiment of the horizontal type continuous casting machine of the present invention for casting molten steel into a cast steel strand. In FIG. 5, 6 is a horizontal metal mold having a cooling water passage 6B. The horizontal mold 6 is connected through a front nozzle (not shown), a feed nozzle 4, a break ring 5 and a metal spacer ring 8 as shown in FIG. 6 to an opening provided in the lower portion of a side wall of a tundish (not shown) for receiving molten steel.

The spacer ring 8 is made, just as the horizontal mold 6, of copper or a copper alloy added with beryllium, and has therein a cooling water passage 8A. Cooling water circulates through the cooling water passage 8A to cool the spacer ring 8. The inner bore 9 of the spacer ring 8 formed by the downstream side 8B of the inner surface of the spacer ring 8 has a square cross-sectional shape, just as the inner bore 10 of the horizontal mold 6 formed by the inner surface 6C of the horizontal mold 6. The inner bore 9 of the spacer ring 8 forms a horizontal passage for molten steel in cooperation with the inner bore 10 of the horizontal mold 6, the opening in the lower portion of the side wall of the tundish, the front nozzle, the feed nozzle 4 and the break ring 5. The upstream side 8C of the inner surface of the spacer ring 8 is formed so as to match with the tapered outer surface 5A of the break ring 5, and the downstream side 8D of the outer surface of the spacer ring 8 is formed so as to match with the tapered inlet end 6A of the horizontal mold 6. By urging the break ring 5 toward the horizontal mold 6 by means of the feed nozzle 4, the outer surface 5A of the break ring 5 comes into a liquid-tight contact with the upstream side 8C of the inner surface of the spacer ring 8, and the downstream side 8D of the outer surface of the spacer ring 8 comes into a liquid-tight contact with the inlet end 6A of the horizontal mold 6.

At least one pair of pinch rolls (not shown) and a cooling zone (not shown) are arranged following the horizontal mold 6. The at least one pair of pinch rolls intermittently and continuously withdraws molten steel directed to the spacer ring 8 and the horizontal mold 6 into a cast steel strand 11 in the horizontal direction through the horizontal mold 6 by means of a plurality of cycles each comprising one pull and one push. The cooling zone cools the cast steel strand 11 thus withdrawn from the horizontal mold 6.

According to the above-mentioned first embodiment of the horizontal type continuous casting machine of the present invention, the cast steel strand 11 is manufactured as follows. Molten steel received in the tundish is introduced through the front nozzle (not shown), the feed nozzle 4 and the break ring 5 into the spacer ring 8 and the horizontal mold 6. Molten steel introduced into the spacer ring 8 and the horizontal mold 6 is intermittently and continuously withdrawn into the cast steel strand 11 in the horizontal direction through the horizontal mold 6 by the at least one pair of pinch rolls (not shown). Then, the cast steel strand II thus withdrawn from the horizontal mold 6 is cooled while passing through the cooling zone (not shown). The cast steel strand 11 is thus continuously cast.

In the first embodiment of the horizontal type continuous casting machine of the present invention, in which the metal spacer ring 8 is provided between the break ring 5 and the horizontal mold 6, it suffices to conduct the fitting operation only between the break ring 5 and the spacer ring 8 when connecting the downstream end of the break ring 5 to the inlet end 6A of the horizontal mold 6, and accordingly the fitting operation of the break ring 5 to the spacer ring 8 can be easily conducted offline. It is therefore possible to easily achieve a liquid-tight connection of the downstream end of the break ring 5 to the inlet end 6A of the horizontal mold 6 in a short period of time.

In the above-mentioned first embodiment, the horizontal type continuous casting machine of the present invention for casting molten steel into a cast steel strand having square cross-section has been described. The present invention is applicable also to a horizontal type continuous casting machine for casting molten steel into a cast steel strand having a circular cross-section.

Figure 7:
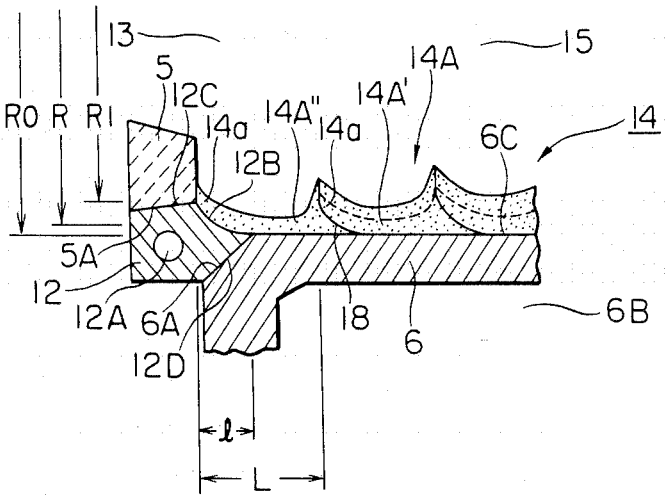
FIG. 7 is a partial vertical sectional view illustrating an essential part of a second embodiment of the horizontal type continuous casting machine of the present invention for casting molten steel into a cast steel strand.

FIG. 7 is a partial vertical sectional view illustrating an essential part of a second embodiment of the horizontal type continuous casting machine of the present invention for casting molten steel into a cast steel strand. The most important feature of the horizontal type continuous casting machine of the second embodiment lies in that the cross-sectional size of the inner bore of the above-mentioned metal spacer ring provided between the break ring and the horizontal mold becomes gradually smaller toward the downstream end of the break ring. More particularly, as shown in FIG. 7, the diameter R of the inner bore 13 of the spacer ring 12, having a circular cross-section, which inner bore 13 is formed by the downstream side 12B of the inner surface of the spacer ring 12, becomes gradulally smaller from the maximum diameter $R_o$ at the downstream end of the inner bore 13 to the minimum diameter $R_1$ at the upstream end of the inner bore 13 along a smooth concave face over the downstream side 12B of the inner surface of the spacer ring 12. The maximum diameter $R_o$ of the inner bore 13 is substantially equal to the diameter of the cast steel strand 14 having a circular cross-section which is cast by the horizontal mold 6, i.e., equal to the diameter of the inner bore 15 of the horizontal mold 6, having a circular cross-section, which inner bore 15 is formed by the inner surface 6C of the horizontal mold 6.

Similarly to the spacer ring 8 of the above-mentioned first embodiment of the present invention, the spacer ring 12 of the second embodiment has therein a cooling water passage 12A. The downstream side 12D of the outer surface of the spacer ring 12 comes into a liquid-tight contact with the inlet end 6A of the horizontal mold 6, and the upstream side 12C of the inner surface of the spacer ring 12 comes into a liquid-tight contact with the outer surface 5A of the break ring 5. The inner bore 13 of the spacer ring 12 forms a horizontal passage for molten steel in cooperation with the inner bore 15 of the horizontal mold 6, the opening in the lower portion of the side of the tundish (not shown), the front nozzle (not shown), the feed nozzle (not shown) and the break ring 5.

The other structures of the horizontal type continuous casting machine of the second embodiment are the same as those of the horizontal type continuous casting machine of the first embodiment shown in FIG. 5.

The cross-section of the inner bore 13 of the spacer ring 12 of the second embodiment of the present invention is gradually reduced from the downstream end of the inner bore 13 toward the downstream end of the break ring 5 for the following reason.

Figure 2:
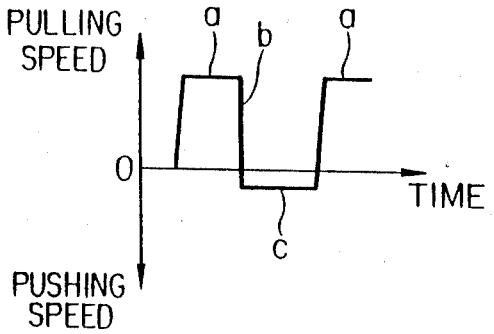
FIG. 2 (PRIOR ART)
FIG. 2 is a descriptive view illustrating an example of one cycle comprising one pull and one push for intermittently and continuously withdrawing a cast steel strand from a horizontal mold in the horizontal direction.

FIG. 2 is a descriptive view illustrating an example of one cycle comprising one pull and one push for intermittently and continuously withdrawing a cast steel strand from a horizontal mold in the horizontal direction. In FIG. 2, the abscissa represents time, and the ordinate indicates a pulling speed of the cast steel strand in the portion above point "0" and a pushing speed of the cast steel strand in the portion below point "0". In FIG. 2, the portion "a" represents the pull period in the above-mentioned one cycle, the portion "b", the last stage of the pull period in the one cycle, and the portion "c", the push period in the one cycle.

Figure 1:
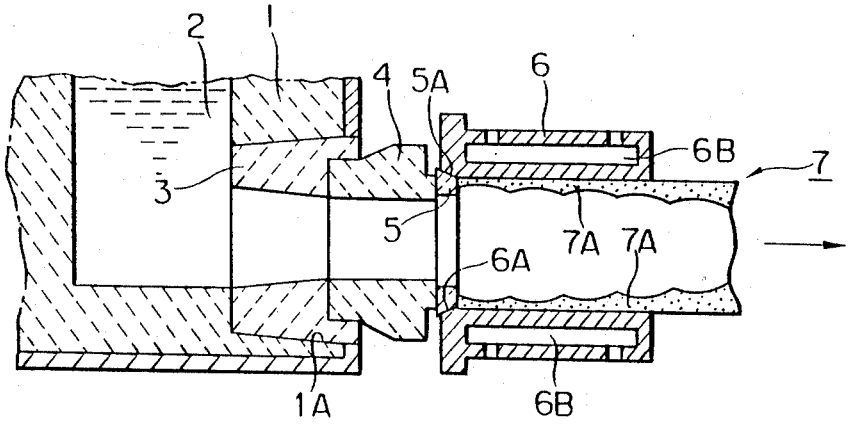
FIG. 1 (PRIOR ART)
FIG. 1 is a schematic vertical sectional view illustrating a conventional horizontal type continuous casting machine for casting molten steel into a cast steel strand.
Figure 3:
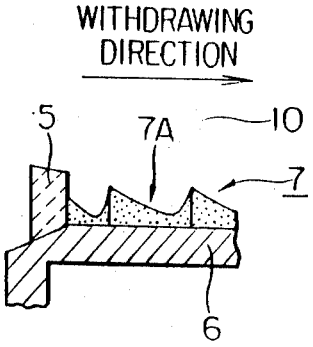
FIG. 3 (A) (PRIOR ART)
FIG. 3(A) is a partial sectional view illustrating formation of a solidified shell of a cast steel strand during a pull period in one cycle comprising one pull and one push for intermittently and continuously withdrawing a cast steel strand in the horizontal direction from a horizontal mold of the conventional horizontal type continuous casting machine as shown in FIG. 1.
FIG. 3(B) is a partial sectional view illustrating formation of a solidified shell of a cast steel strand during the last stage of the pull period in one cycle comprising one pull and one push for intermittently and continuously withdrawing the cast steel strand in the horizontal direction from a horizontal mold of the conventional horizontal type continuous casting machine as shown in FIG. 1.
FIG. 3(C) is a partial sectional view illustrating formation of a solidified shell of a cast steel strand during a push period in one cycle comprising one pull and one push for intermittently and continuously withdrawing the cast steel strand in the horizontal direction from a horizontal mold of the conventional horizontal type continuous casting machine as shown in FIG. 1.
Figure 3:
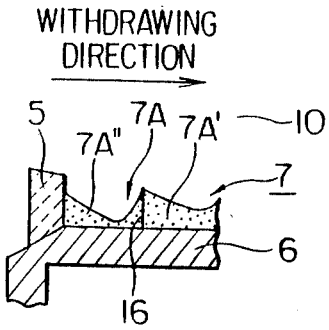
FIG. 3 (B) (PRIOR ART)
Figure 3:
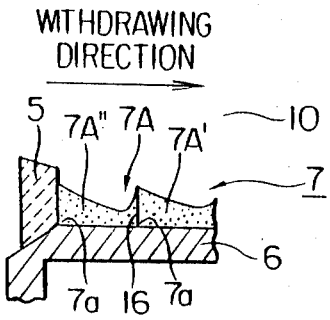
FIG. 3 (C) (PRIOR ART)

FIGS. 3(A) to 3(C) are partial sectional views illustrating formation of a solidified shell 7A of a cast steel strand 7 in the inner bore of the horizontal mold 6 when withdrawing the cast steel strand 7 from the horizontal mold 6 of the conventional horizontal type continuous casting machine shown in FIG. 1 according to the method as mentioned above. FIG. 3(A) illustrates formation of the solidified shell 7A of the cast steel strand 7 during the pull period in the above-mentioned one cycle, FIG. 3(B) illustrates formation of the solidified shell 7A of the cast steel strand 7 during the last stage of the pull period in the one cycle, and FIG. 3(C) illustrates formation of the solidified shell 7A of the cast steel strand 7 during the push period in the one cycle. Intermittent withdrawal of the cast steel strand 7 has the effect of causing a thin solidified shell 7A formed near the break ring 5 during the pull period in one cycle to grow thick during the push period in this cycle, so as to prevent the solidified shell 7A from breaking during the pull period in the next cycle.

However, since the cast steel strand 7 is intermittently and continuously withdrawn from the horizontal mold 6 by means of a plurality of cycles each comprising one pull and one push, a junction face which is called a cold shut 16 is produced in the solidified shell 7A of the cast steel strand 7 between a unit shell 7A' formed during one cycle and another unit shell 7A" newly formed during the next one cycle, as shown in FIGS. 3(A) to 3(C). The cold shut 16 causes no problem so far as it is sufficiently welded, but when welding is insufficient, a crack is produced on the surface portion of the solidified shell 7A of the cast steel strand 7 in the horizontal mold 6 along the cold shut 16 during the pull period in one cycle for withdrawing the cast steel strand 7.

As shown in FIGS. 1 and 3(A) to 3(C), a corner portion **7*a* of the unit shell 7A' of the solidified shell 7A is in contact with a corner of the inner bore 10 of the horizontal mold 6 (hereinafter referred to as the "corner of the inner bore 10"), which corner of the inner bore 10 is formed by the horizontal mold 6 and the break ring 5 of the conventional horizontal type continuous casting machine. Therefore, the corner portion 7*a* of the unit shell 7A' is cooled by means of both the horizontal mold 6 and the break ring 5 more remarkably than the other portion of the unit shell 7A', which is in contact only with the horizontal mold 6, during the push period in one cycle for withdrawing the cast steel strand 7, and as a result, the temperature of the corner portion 7*a* of the unit shell 7A'** is largely reduced.

Figure 4:
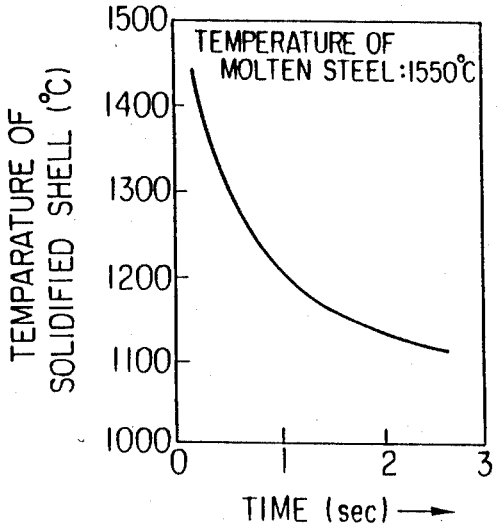
FIG. 4 (PRIOR ART)
FIG. 4 is a graph illustrating the decrease in temperature of a corner portion of a unit shell of a solidified shell of a cast steel strand, which is in contact with a corner of the inner bore of a horizontal mold of the conventional horizontal type continuous casting machine as shown in FIG. 1.

FIG. 4 is a graph illustrating the decrease in temperature of the corner portion **7*a* of the unit shell 7A' of the solidified shell 7A, which is in contact with the corner of the inner bore 10 of the horizontal mold 6 of the above-mentioned conventional horizontal type continuous casting machine. As shown in FIG. 4, the temperature of the corner portion 7*a* of the unit shell 7A' is largely reduced during a very short period of time of only from about 0.1 to about 0.3 second for which the corner portion 7*a* of the unit shell 7A' stays in the corner of the inner bore 10. If the temperature of the corner portion 7*a* of the unit shell 7A', which is formed during one cycle for withdrawing the cast steel strand 7, is low, the unit shell 7A", which is newly formed during the next one cycle cannot sufficiently be welded together with the corner portion 7*a* of the preceding unit shell 7A'. Empirically, when the temperature of the corner portion 7*a* of the preceding unit shell 7A' decreases to below 1,400° C., the corner portion 7*a* of the preceding unit shell 7A' can not sufficiently be welded together with the newly formed unit shell 7A". As a result, an insufficiently welded cold shut 16 is produced between the unit shell 7A' having the low-temperature corner portion 7*a*, which is formed during one cycle and the unit shell 7A"**, which is newly formed during the next one cycle.

In general, when the number of the cycles for withdrawing the cast steel strand 7 from the horizontal mold 6 is larger than 150 cycles/minute, the cold shuts 16 are sufficiently welded. In this case, however, a considerable load is imposed on the withdrawal facilities of cast steel strand 7 including the pinch rolls. The number of the cycles is therefore practically limited within the range of from 50 to 150 cycles/minute. With the number of the cycles within this range, insufficiently welded cold shuts 16 are produced in the horizontal mold 6 for the above-mentioned reason, and thus cracks are produced along the insufficiently welded cold shuts 16.

Also in the first embodiment of the present invention shown in FIG. 5, a corner portion **11*a* of a unit shell 11A' of a solidified shell 11A of the cast steel strand 11 is in contact with a corner of the inner bore 9 of the spacer ring 8 (hereinafter referred to as the "corner of the inner bore 9"), which corner of the inner bore 9 is formed by the spacer ring 8 and the break ring 5. Therefore, the corner portion 11*a* of the unit shell 11A' is cooled more remarkably than the other portion of the unit shell 11A' during the push period in one cycle for withdrawing the cast steel strand 11, and as a result, the temperature of the corner portion 11*a* of the unit shell 11A' is largely reduced. Therefore, there is a possibility of producing an insufficiently welded cold shut 17 between the unit shell 11A' having the low-temperature corner portion 11*a*, which is formed during one cycle and another unit shell 11A"**, which is newly formed during the next one cycle.

On the contrary to the above, in the second embodiment of the present invention as shown in FIG. 7, the thickness of the wall of the spacer ring 12 near the corner of the inner bore 13 formed by the downstream side 12B of the inner surface of the spacer ring 12, is larger than the thickness of the wall of the spacer ring 8 near the corner of the inner bore 9 of the spacer ring 8 of the first embodiment of the present invention shown in FIG. 5. Therefore, a corner portion **14*a* of a unit shell 14A' of a solidified shell 14A of a cast steel strand 14, which corner portion 14***a* is in contact with the corner of the inner bore 13 of the spacer ring 12, is cooled less than the corner portion 11*a* of the unit shell 11A' of the solidified shell 11A of the cast steel strand 11, which corner portion 11*a* is in contact with the corner of the inner bore 9 of the spacer ring 8 of the first embodiment shown in FIG. 5.

Furthermore, when the corner portion 14*a* of the unit shell 14A' leaves the corner of the inner bore 13 of the spacer ring 12 during the pull period in the next cycle, the corner portion 14*a* of the unit shell 14A' comes into contact neither with the cooled spacer ring 12 nor with the cooled horizontal mold 6, and is surrounded by the high-temperature molten steel flowing from the tundish into the spacer ring 12 and the horizontal mold 6. Therefore, the corner portion 14*a* of the unit shell 14A' rapidly recovers heat from the high-temperature molten steel, and is sufficiently welded together with a unit shell 14A" which is newly formed during the next one cycle. Thus, a sufficiently welded cold shut 18 is produced between the unit shell 14A' and the unit shell 14A", and no crack occurs on the surface of the cast steel strand 14 along the cold shut 18. In addition, the above-mentioned cold shut 18, which is produced in an inclined shape, is easily crushed during rolling of the cast steel strand 14 and disappears.

According to the second embodiment of the horizontal type continuous casting machine of the present invention, it is possible to prevent occurrence of cracks on the surface portion of the cast steel strand 14 along the cold shuts 18, as described above, and moreover, the following additional effect is available. More specifically, a recess caused by partial erosion may be produced during casting not only near the corner of the inner bore 9 of the spacer ring 8 in the horizontal type continuous casting machine of the first embodiment, but also near the corner of the inner bore 13 of the spacer ring 12 in the horizontal type continuous casting machine of the second embodiment, just as near the corner of the inner bore of the horizontal mold 6 in the above-mentioned conventional horizontal type continuous casting machine. However, in the case of the spacer ring 12 of the second embodiment, since the recess is produced near the corner of the inner bore 13 at an obtuse angle relative to the withdrawing direction of the cast steel strand 14, resistance of the solidified shell formed in the recess to the pulling force of the cast steel strand 14 is relatively small. Therefore, the solidified shell 14A of the cast steel strand 14 is never broken during the pull period in one cycle.

As described above, the diameter R of the inner bore 13 of the spacer ring 12 of the second embodiment of the present invention shown in FIG. 7 becomes gradually smaller from the maximum diameter $R_o$ at the downstream end of the inner bore 13 to the minimum diameter $R_1$ at the upstream end of the inner bore 13 along a smooth concave face over the downstream side 12B of the inner surface of the spacer ring 12, which forms the inner bore 13 thereof. According to experience, the cold shuts 18 are most sufficiently welded when the difference between the maximum diameter $R_o$ and the minimum diameter $R_1$ of the inner bore 13 is within the range of from 4 to 20 mm.

The length l of the downstream side 12B of the inner surface of the spacer ring 12, which forms the inner bore 13 of the spacer ring 12, should preferably be up to the distance L of one pull in one cycle for withdrawing the cast steel strand 14. If the above-mentioned length l is longer than the distance L of one pull in one cycle, the diameter of the tip of the solidified shell 14A of the cast steel strand 14, which sticks to the end face of a dummy bar inserted into the inner bore 15 of the horizontal mold 6 at the beginning of casting of the cast steel strand 14 becomes smaller than the diameter of the cast steel strand 14. As a result, when the solidified shell 14A of the cast steel strand 14, which sticks to the end face of the dummy bar, is pulled by the dummy bar in the withdrawal direction by the above-mentioned distance L of one pull, a gap is produced between the solidified shell 14A sticking to the end face of the dummy bar and the inner bore 15 of the horizontal mold 6, and molten steel may leak through this gap toward the outlet end of the horizontal mold 6. Since the distance L of one pull is practically within the range of from 5 to 30 mm, the above-mentioned length l should preferably be up to the range of from 5 to 30 mm. As can be derived from the foregoing, a straight line which joins both ends of the outlet side 12B of the inner surface of the spacer ring 12 in a plane including the axial line of the spacer ring 12 has an inclination angle within the range of from 4° to 64° relative to the axial line of the spacer ring 12.

Figure 8:
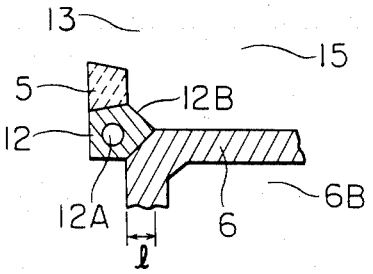
FIG. 8(A) is a partial vertical sectional view illustrating an essential part of a third embodiment of the horizontal type continuous casting machine of the present invention for casting molten steel into a cast steel strand.
FIG. 8(B) is a partial vertical sectional view illustrating an essential part of a fourth embodiment of the horizontal type continuous casting machine of the present invention for casting molten steel into a cast steel strand.
Figure 8:
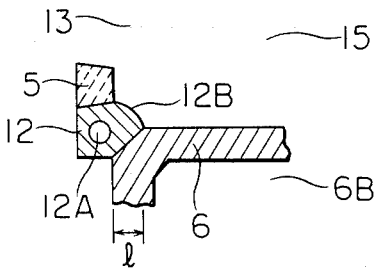

FIG. 8(A) is a partial vertical sectional view illustrating an essential part of a third embodiment of the horizontal type continuous casting machine of the present invention for casting molten steel into a cast steel strand. As shown in FIG. 8(A), the diameter of the inner bore 13 of a spacer ring 12 of the third embodiment of the present invention becomes linearly and gradually smaller from the maximum diameter at the downstream end of the inner bore 13 to the minimum diameter at the upstream end of the inner bore 13 over the downstream side 12B of the inner surface of the spacer ring 12, which forms the inner bore 13 thereof. The other structures of the horizontal type continuous casting machine of the third embodiment shown in FIG. 8(A) are the same as those of the horizontal type continuous casting machine of the second embodiment shown in FIG. 7.

FIG. 8(B) is a partial vertical sectional view illustrating an essential part of a fourth embodiment of the horizontal type continuous casting machine of the present invention for casting molten steel into a cast steel strand. As shown in FIG. 8(B), the diameter of the inner bore 13 of a spacer ring 12 of the fourth embodiment of the present invention becomes gradually smaller from the maximum diameter at the downstream end of the inner bore 13 to the minimum diameter at the upstream end of the inner bore 13 along a smooth convex face over the downstream side 12B of the inner surface of the spacer ring 12, which forms the inner bore 13 thereof. The other structures of the horizontal type continuous casting machine of the fourth embodiment shown in FIG. 8(B) are the same as those of the horizontal type continuous casting machine of the second embodiment shown in FIG. 7.

In the above-mentioned embodiments 2 to 4, the horizontal type continuous casting machines for casting molten steel into a cast steel strand of a circular cross-section have been described, but the present invention is applicable also to a horizontal type continuous casting machine for casting molten steel into a cast steel strand of a square cross-section. In the case of a horizontal type continuous casting machine for casting molten steel into a cast steel strand of a square cross-section, the inner bore of the spacer ring has a square cross-sectional shape equal to that of the inner bore of the horizontal mold, and the dimensions of the inner bore of the square cross-section of the spacer ring are determined on the basis of a length of a side of the inner bore of the square cross-section of the spacer ring instead of the diameter R of the inner bore 13 of the circular cross-section of the spacer ring 12 for casting molten steel into the cast steel strand 14 of the circular cross-section.

According to the horizontal type continuous casting machine of the present invention, as described above in detail, the downstream end of the break ring can easily and liquid-tightly be connected to the inlet end of the horizontal mold in a short period of time. In addition, since the cross-section of the inner bore of the spacer ring becomes gradually smaller toward the downstream end of the break ring, it is possible to sufficiently weld the cold shuts which are produced on the surface portion of the solidified shell of the cast steel strand when intermittently and continuously withdrawing molten steel directed from the tundish to the spacer ring and the horizontal mold into a cast steel strand through the horizontal mold, thus permitting prevention of occurrence of cracks along the cold shuts.

What is claimed is:

1. A horizontal type continuous casting machine for casting molten steel into a cast steel strand, which comprises:

a tundish for receiving molten steel to be cast; a horizontal metal mold connected through a front nozzle, a feed nozzle and a break ring to an opening provided in the lower portion of a side wall of said tundish, an inlet end of said front nozzle being inserted into said opening of said tundish, an outlet end of said front nozzle being connected to an inlet end of said feed nozzle, an outlet end of said feed nozzle being connected to an inlet end of said break ring, an outlet end of said break ring being connected to an inlet end of said horizontal mold, said horizontal mold having an inner surface defining an inner bore therein; and said break ring having an outer surface; said opening of said tundish, said front nozzle, said feed nozzle, said break ring and said horizontal mold forming a horizontal passage for molten steel; at least one pair of pinch rolls for intermittently and continuously withdrawing molten steel directed from said tundish through said front nozzle, said feed nozzle and said break ring to said horizontal mold into a cast steel strand in the horizontal direction through said horizontal mold; operating means drivingly coupled to said at least one pair of pinch rolls to alternatively drive said at least one pair of pinch rolls in first respective directions to produce a pull stroke of a predetermined distance (L) and in second respective directions to produce a push stroke, which pull and push strokes are repeated, so that said cast steel strand is intermittently and continuously withdrawn from said horizontal mold in a plurality of cycles, each said cycle comprising one pull corresponding to said pull stroke of said predetermined distance (L) and one push corresponding to said push stroke; and a cooling zone for cooling said cast steel strand withdrawn from said horizontal mold;

the improvement comprising:

a metal spacer ring (12) having therein a cooling water passage (12A), said spacer ring being coupled between said break ring (5) and said horizontal mold (6); said spacer ring having an inlet side, an outlet side, an inner surface, at least part of said inner surface defining an inner bore, and an outer surface, said outlet side (12D) of said outer surface of said spacer ring (12) being in contact with said inlet end (6A) of said horizontal mold (6), said inlet side (12C) of said inner surface of said spacer ring (12) being in contact with said outer surface (5A) of said break ring (5), and said inner bore (13) of said spacer ring (12), formed by said outlet side (12B) of said inner surface of said spacer ring (12), forming part of said horizontal passage for molten steel in cooperation with said inner bore (15) of said horizontal mold (6);

the cross-section of said inner bore (13) of said spacer ring (12) becoming gradually smaller toward said outlet end of said break ring (5) along one of a substantially smooth linear face, a substantially smooth concave face and a substantially smooth convex face over said outlet side (12B) of the inner surface of said spacer ring (12); and a straight line which joins both ends of said outlet side (12B) of said inner surface of said spacer ring (12) in a plane including the axial line of said spacer ring (12), having an inclination angle within the range of from 4° to 64° relative to said axial line of said spacer ring (12).

2. The horizontal type continuous casting machine as claimed in claim 1, wherein:

the length (l) of said outlet side (12B) of said inner surface of said spacer ring (12) is equal to or less than said predetermined distance (L) of said pull stroke of said at least one pair of pinch rolls.

3. The horizontal type continuous casting machine as claimed in claim 1 or 2, wherein:

said inner bore (15) of said horizontal mold (6) and said inner bore (13) of said spacer ring (12) have a substantially circular cross-sectional shape.

4. The horizontal type continuous casting machine as claimed in claim 1 or 2, wherein:

said inner bore (15) of said horizontal mold (6) and said inner bore (13) of said spacer ring (12) have a substantially square cross-sectional shape.

5. The horizontal type continuous casting machine as claimed in claim 1 or 2, wherein:

said inner bore (15) of said horizontal mold (6) and said inner bore (13) of said spacer ring (12) have a substantially rectangular cross-sectional shape.

* * * * *